US006907878B1

(12) United States Patent
Resnick

(10) Patent No.: US 6,907,878 B1
(45) Date of Patent: Jun. 21, 2005

(54) PROTECTIVE HOOD WITH ADJUSTABLE VISOR

(76) Inventor: Todd A. Resnick, P.O. Box 1559, Stuart, FL (US) 34995-1559

( * ) Notice: Subject to any disclaimer, the term of this patent is extended or adjusted under 35 U.S.C. 154(b) by 53 days.

(21) Appl. No.: 10/711,898

(22) Filed: Oct. 12, 2004

Related U.S. Application Data

(63) Continuation of application No. 10/248,070, filed on Dec. 16, 2002, now Pat. No. 6,817,358.

(51) Int. Cl.[7] ..... A62B 17/04; A62B 19/00

(52) U.S. Cl. ..... 128/201.22; 128/201.25; 128/201.23

(58) Field of Search ..... 128/200.24, 200.27, 128/200.28, 201.12, 201.14, 201.15, 201.17, 128/201.22, 201.23, 201.24, 201.25, 201.29, 128/202.11, 202.19, 205.25, 206.16, 206.19, 128/206.17, 206.21, 206.23, 206.24, 206.26, 128/206.27, 207.11; 2/6.3, 6.7, 171, 171.2, 2/173, 427, 429, 435, 438

(56) References Cited

U.S. PATENT DOCUMENTS 2,631,287 A * 3/1953 Malcolm, Jr. ..... 2/9
2,799,862 A * 7/1957 Rowe ..... 2/9
2,918,060 A * 12/1959 Lobelle ..... 128/201.24
3,310,811 A * 3/1967 Iacono, Jr. ..... 2/6.5
3,528,415 A * 9/1970 Malmin ..... 128/201.12
4,090,509 A * 5/1978 Smith ..... 128/202.19
4,709,696 A * 12/1987 Angell ..... 128/201.12
4,764,990 A * 8/1988 Markert ..... 2/429
4,870,959 A * 10/1989 Reisman et al. ..... 128/201.25
5,235,972 A * 8/1993 Strong ..... 128/206.21
5,261,398 A * 11/1993 Sobolik ..... 128/206.23
5,349,949 A * 9/1994 Schegerin ..... 128/206.24
5,421,326 A * 6/1995 Rankin et al. ..... 128/201.19
5,549,104 A * 8/1996 Crump et al. ..... 128/201.25
5,628,308 A * 5/1997 Harges, Jr. et al. ..... 128/206.21
5,653,225 A * 8/1997 Schegerin ..... 128/201.24
5,682,879 A * 11/1997 Bowers ..... 128/206.19
5,704,073 A * 1/1998 Sword et al. ..... 2/427
5,823,188 A * 10/1998 Harges, Jr. et al. ..... 128/206.19
6,302,103 B1 * 10/2001 Resnick ..... 128/201.23
6,681,765 B2 * 1/2004 Wen ..... 128/201.25
6,817,358 B1 * 11/2004 Resnick ..... 128/201.22

* cited by examiner

*Primary Examiner*—Henry Bennett
*Assistant Examiner*—Teena Mitchell
(74) *Attorney, Agent, or Firm*—Anton J. Hopen; Smith & Hopen, P.A.

(57) ABSTRACT

A flexible hood has an upper part and a lower part formed integrally with the upper part. A visor is carried by the upper part and a filter is mounted to the lower part on an external side. In a first configuration, the visor is positioned away from a user's face to accommodate spectacles or goggles. In other configurations, the visor is positioned closer to the user's face to reduce the "tunnel vision" effect created by the first configuration. A continuous loop strap joins together the upper and lower parts of the hood to provide an infinite number of positions of adjustment. When the hood is not worn, it is placed into its fully retracted configuration and then compressed so that it occupies less space. When so compressed, it is folded in half with the visor abutting the filter. This storage configuration protects the visor from damage.

14 Claims, 7 Drawing Sheets

PROTECTIVE HOOD WITH ADJUSTABLE VISOR

CROSS REFERENCE TO RELATED DISCLOSURE

This disclosure is a continuation-in-part of U.S. patent application bearing Ser. No. 10/248,070, filed Dec. 16, 2002, now U.S. Pat. No. 6,817,358 by the present inventor.

BACKGROUND OF THE INVENTION

1. Field of the Invention

This invention relates, generally, to protective wear such as gas masks. More particularly, it relates to a protective hood having a visor that may be extended into a position for accommodating the head of a user wearing spectacles and retracted into a position close to the user's eyes to increase the field of vision.

2. Description of the Prior Art

Flexible hoods that receive the entire head of a user and which are equipped with filters to protect the wearer from toxins, germs, and the like that may be in the ambient air external to the hood have several drawbacks.

For example, some hoods lack sufficient interior space to comfortably accommodate spectacles, goggles, and the like that may be worn by a user. It is not an acceptable solution to make all flexible hoods of sufficient size to accommodate spectacles, however, because a one-size-fits-all hood would be too large for a user who does not wear spectacles. A hood that is too large decreases the field of vision of the wearer, creating tunnel vision because the user's eyes are spaced far rearwardly of the visor. Ideally, the user's eyes should be positioned near the visor when the hood is in use to thereby maximize the user's field of vision.

Another drawback relates to the creases formed in a conventional full hood visor when it is folded over for storage where the visor abuts the filter or filters mounted below the visor.

What is needed, then, is a visor that accommodates users wearing spectacles, goggles, and the like and users not wearing such items, and which provides to both classes of users an optimal field of vision.

A need also exists for a flexible hood construction that enables the hood to be folded for storage purposes without causing creasing of the visor by the filter or filters.

However, in view of the prior art considered as a whole at the time the invention was made, it was not obvious to those of ordinary skill in the art how the identified needs could be met.

SUMMARY OF THE INVENTION

The long-standing but heretofore unfulfilled need for a flexible hood that provides an optimal field of view for various users and which is storable without damaging the visor of the hood is now met by a new, non-obvious, and useful invention. The novel flexible hood of this invention includes an upper part having a visor adapted to enable a user to see therethrough when the flexible hood is worn. A lower part of the flexible hood is formed integrally with the upper part thereof.

A filter housing having a filter therein is secured to an external side of the lower part and a mouthpiece is positioned in an interior of the flexible hood, in the lower part. The mouthpiece is in fluid communication with the filter so that the user may breath filtered air through the mouth.

In a first embodiment, a nose clip is positioned in an interior of the flexible hood, in the upper part, so that the user does not breathe through the nose. A nose clip base is secured to the upper part of the flexible hood. More particularly, the visor is apertured to receive the nose clip base and the aperture is sealed by the nose clip base at its perimeter. The nose clip is formed integrally with the nose clip base by means of a flexible membrane so that the free end of the nose clip (the end not adapted to engage the nose of a user) may protrude externally of the hood without admitting ambient air into the hood. This enables users having a wide variety of head and nose sizes to wear the flexible hood. For a child or other person with a small head, the nose clip may be positioned wholly within the interior of the hood. The free end of the nose clip may protrude externally of the hood for persons having larger heads.

A first loop member adapted to slidingly receive a continuous loop strap therethrough is mounted to the external side of the nose clip base in depending relation thereto. The nose clip base and hence the first loop member and the continuous loop strap received therewithin are thus centered with respect to the user's face when the hood is worn. A second loop member adapted to slidingly receive the same continuous loop strap therethrough is mounted to a top wall of the filter housing at a rearward end thereof, and a third loop member adapted to slidingly receive the same continuous loop strap therethrough is mounted to a top wall of the filter housing at a forward end thereof.

The strap in the form of a continuous loop is received within the first, second, and third loop members. The upper part of the flexible hood has a first, extended position where the first and third loop members are in closely spaced relation to one another and has a second, retracted position where the first and second loop members are in closely spaced relation to one another. A user wearing the flexible hood has an increased field of vision when the upper part of the flexible hood is in the second, retracted position. There are an infinite number of positions of adjustment between the first, extended position and the second, retracted position.

Thus, all users don the flexible hood with the upper part thereof in its first, extended position. To place the upper part of the hood in its fully extended position, a user grasps the external filter in one hand and reaches into the interior of the hood with the other hand and grasps the part of the nose clip base that is within said interior. The user then pushes on the nose clip base in a direction towards the filter housing. The above-mentioned continuous loop strap, as constrained by the first, second, and third loop members, causes the upper part of the hood to expand in response to such pushing action. A user with a large head wearing goggles or the like may wear the hood due to its large internal capacity when the upper part is extended.

After the hood has been donned, the user bites down on the mouthpiece to prevent travel of the filter housing and pushes the nose clip or nose clip base towards the face so that the free end of the nose clip may be clipped to the nose. This pushing of the nose clip towards the user's face causes retraction of the upper part of the hood due to the structure of the continuous loop strap and the three loop members through which it extends.

The amount of retraction may be small for a large-headed user wearing spectacles, goggles, and the like. The amount of retraction will increase for a small-headed user wearing spectacles or the like, and the amount of retraction will be greatest for a small-headed user wearing no spectacles or goggles. The retraction of the upper part is desirable because such retraction places the user's eyes closer to the visor, thereby minimizing tunnel vision and maximizing the field of view.

It is therefore understood that a primary advantage of the invention is that it provides a flexible hood that accommodates users having a wide variety of head sizes.

A closely related advantage is the provision of a flexible hood that accommodates users who may wear spectacles, goggles, and the like.

Another important advantage is the flexible hood construction that facilitates storage of the hood in a folded configuration without scratching, creasing, or otherwise marring the visor.

These and other important advantages will become more clear as this disclosure proceeds.

The invention accordingly comprises the features of construction, combination of elements, and arrangement of parts that will be exemplified in the description set forth hereinafter and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE PREFERRED EMBODIMENT

Figure 1:
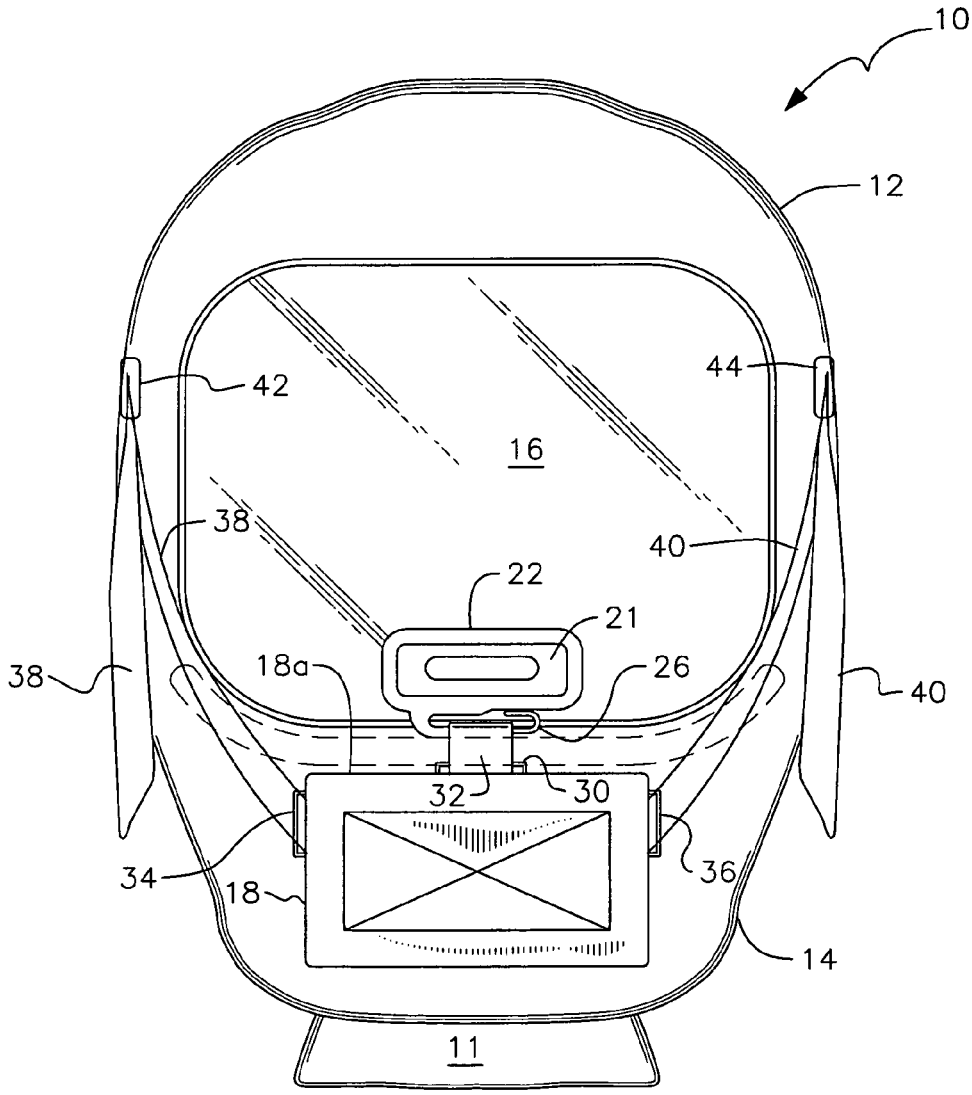
FIG. 1 is a front elevational view of the novel flexible hood.

Flexible hood 10 includes upper part 12, lower part 14, visor 16 that forms a part of said upper part, and filter housing 18 that is secured to said lower part on an external surface thereof. Flexible neck dam 11 depends from lower part 14.

Figure 2:
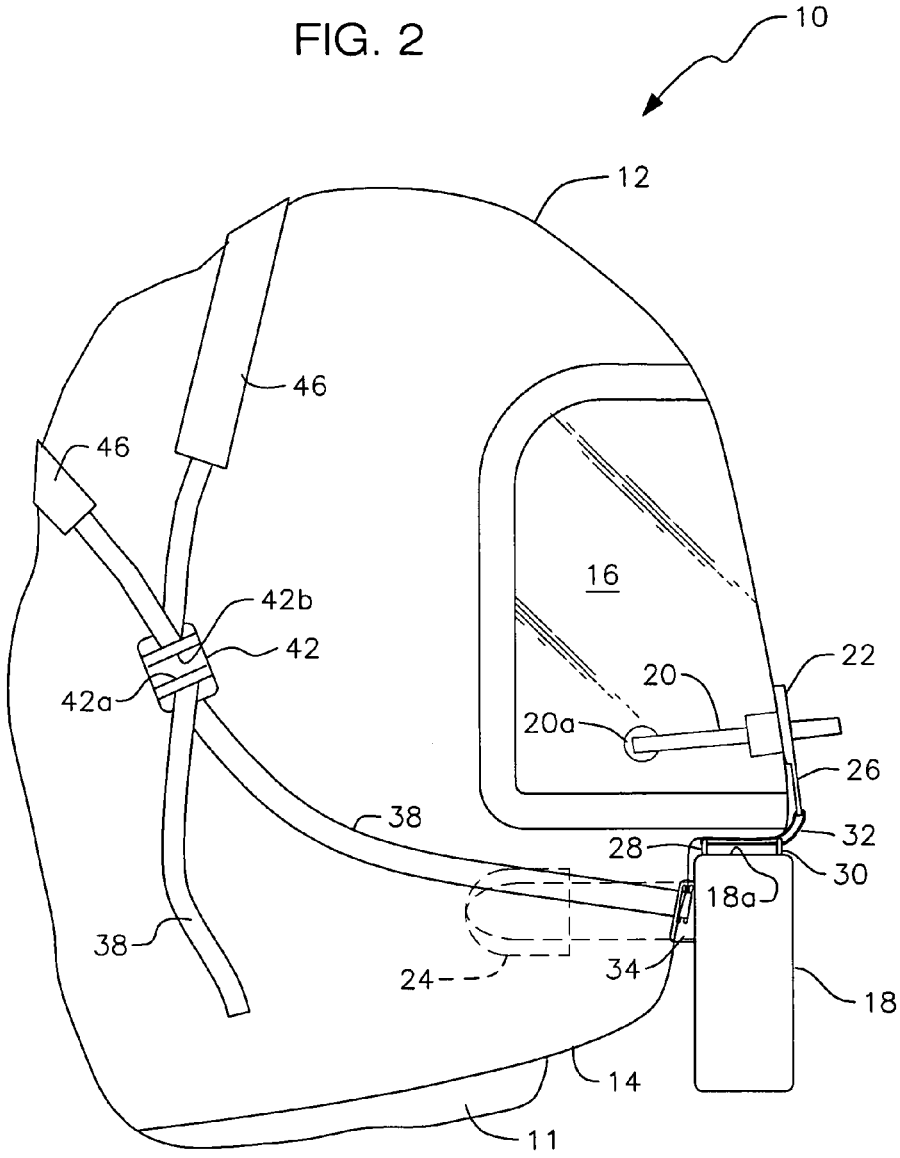
FIG. 2 is a side elevational view depicting a first embodiment with the visor in a first, extended position.
Figure 3:
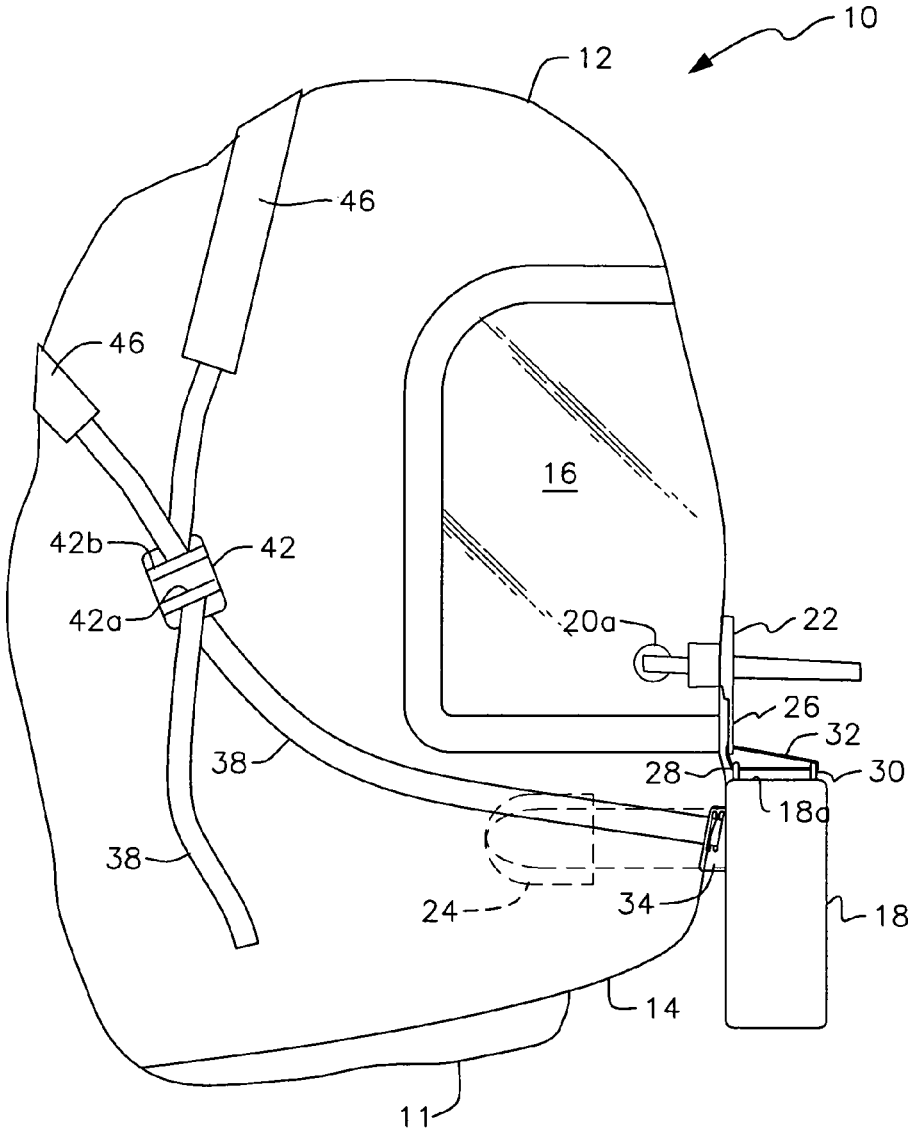
FIG. 3 is a side elevational view depicting said first embodiment with the visor in a second, retracted position.

Nose clip 20, having nose-engaging end 20*a*, is positioned in the interior of flexible hood 10 as depicted in FIGS. 2 and 3. Said nose clip is secured to nose clip base 22 that, in this embodiment, is sealingly mounted about its periphery in an aperture formed in visor 16. Nose clip 20 is connected to nose clip base 22 by an imperforate, flexible membrane 21 (FIG. 1) so that nose-engaging end 20*a* of nose clip 20 may be positioned in retracted relation to visor 16 as depicted in FIG. 2 or in closely spaced relation thereto as depicted in FIG. 3. The membrane is sealingly engaged to nose clip base 22 so ambient air cannot enter into the interior of flexible hood 10 through said nose clip base 22 for any position of nose-engaging end 20*a*.

Mouthpiece 24 is also positioned in the interior of flexible hood 10. Mouthpiece 24 is in fluid communication with the filter, not shown, housed with filter housing 18. Accordingly, a user breathes filtered air through said mouthpiece and does not breath through his or her nose when this embodiment of flexible hood 10 is used.

A first strap-receiving loop member 26 is formed integrally with nose clip base 22 on an external side thereof. A second strap-receiving loop member 28 is formed in top wall 18*a* of filter housing 18 at a rearward end thereof and a third strap-receiving loop member 30 is formed in top wall 18*a* at a forward end thereof.

Strap 32 is formed in a continuous closed loop and extends through said first, second, and third strap-receiving loop members. Each of said loop members has a small opening formed therein to admit said strap thereinto when said strap is folded along its longitudinal axis of symmetry. The strap, when in its flat, unfolded configuration, cannot pass through any of said small openings and is therefore effectively constrained by said loop members.

As depicted in FIG. 2, first and third loop members 26 and 30, respectively, are positioned in close proximity to one another and second loop member 28 is positioned forwardly thereof. This is the first, extended position of upper part 12 and hence of visor 16.

As depicted in FIG. 3, first and second loop members 26 and 28, respectively, are positioned in close proximity to one another and third loop member 30 is positioned forwardly thereof. This is the second, retracted position of upper part 12 and hence of visor 16.

Note that the provision of continuous loop strap 32 and the three loop members 26, 28, and 30 enables placement of upper part 12 and hence visor 16 in any position of adjustment between the fully extended and retracted positions. In this way, a user wearing spectacles may position visor 16 initially in the FIG. 2 fully extended position sufficient to accommodate such spectacles, but after donning flexible hood 10 said user may position visor 16 as close to the spectacles as possible to minimize the afore-mentioned tunnel vision effect. A user not wearing spectacles may retract the visor even further to minimize said tunnel effect.

A user with a small head could fully retract upper part 12 of flexible hood 10 as depicted in FIG. 3, and retract nose clip 20 as needed to a retracted position thereof as depicted in FIG. 2.

Filter strap-engaging loop members 34, 36, respectively, are also mounted to filter housing 18, but said filter strap-engaging members do not perform the same function as the first, second, and third loop members. Filter strap-engaging members 34, 36 engage the respective leading ends of filter strap members 38 and 40, respectively. The respective trailing ends of said filter strap members are adjustably connected to lock members 42, 44, respectively.

More particularly, as best understood in connection with FIGS. 2 and 3, each lock member 42, 44 has a first strap-engaging part (see 42*a* in FIGS. 2 and 3) and a second loop part 42*b* through which extends a continuous loop head strap 46. Accordingly, tightening of filter straps 38, 40 serves to tighten head strap 46.

Figure 4:
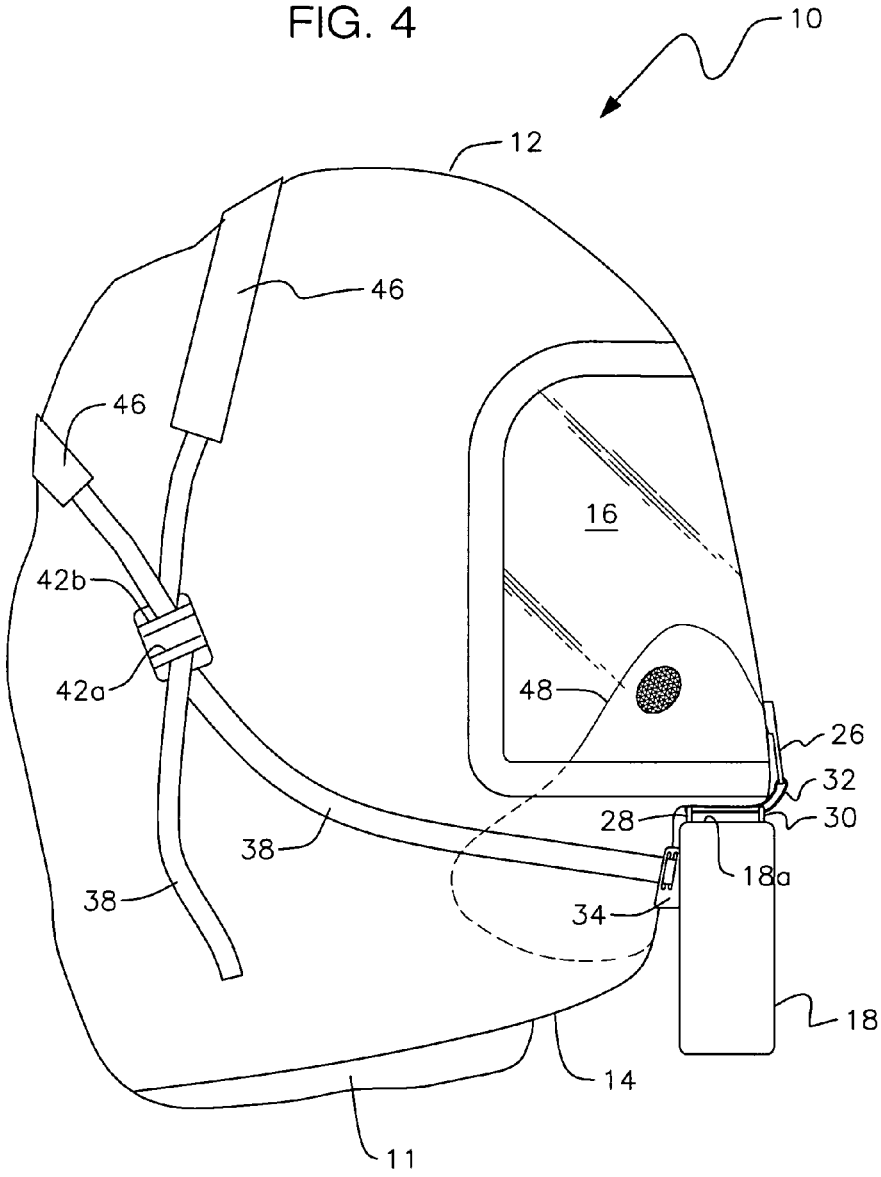
FIG. 4 is a side elevational view depicting a second embodiment with the visor in a first, extended position.
Figure 5:
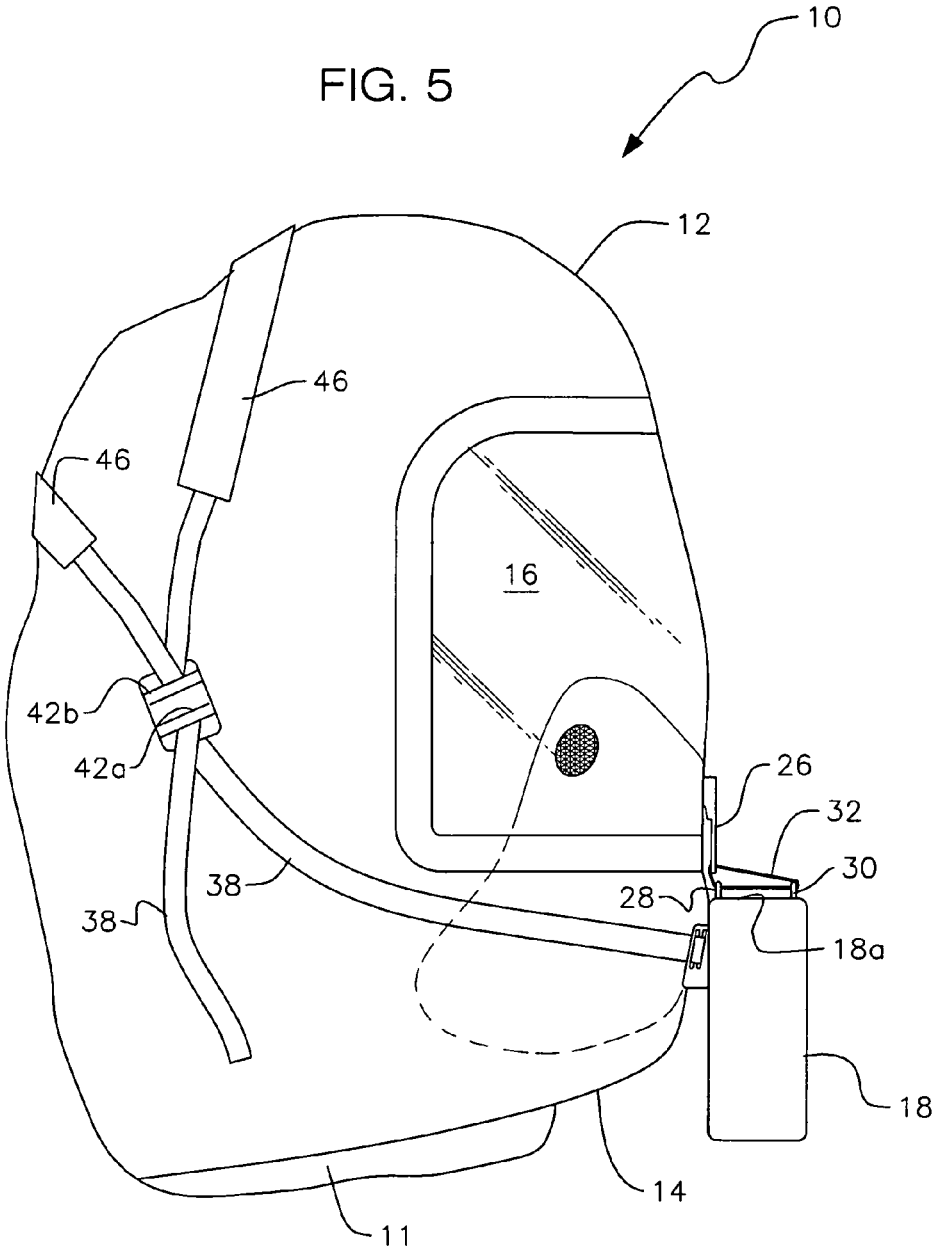
FIG. 5 is a side elevational view depicting said second embodiment with the visor in a second, retracted position.

In FIGS. 4 and 5, nose clip 20 and mouthpiece 24 are replaced with a half-mask cup 48 that covers both the nose and mouth of a user, said half mask cup being positioned in the interior of flexible hood 10. Part of the half-mask cup extends to the exterior of the flexible hood so that first strap-engaging loop member 26 may be formed integrally therewith or mounted thereto. In all other respects, the alternative embodiment of FIGS. 4 and 5 works in the same way as the first embodiment.

Figure 6:
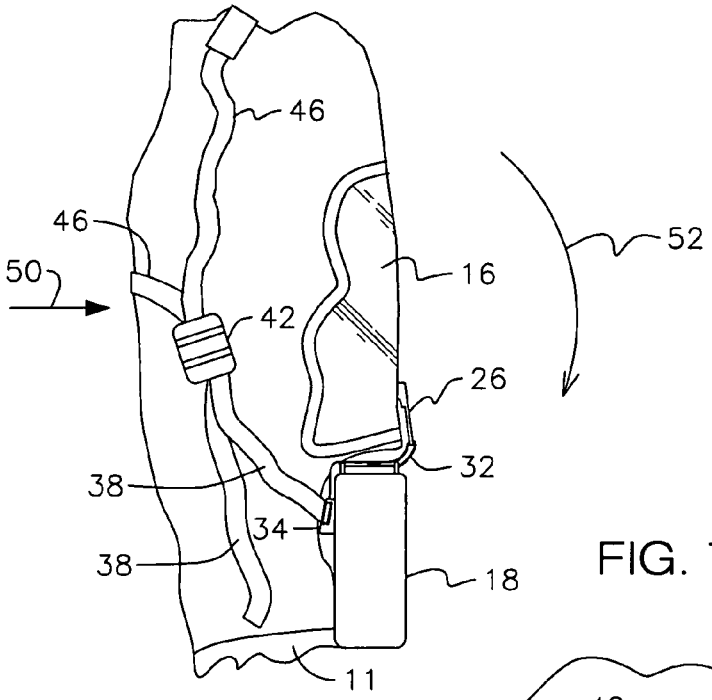
FIG. 6 is a side elevational view depicting a flexible hood having its upper part in the second, retracted position and with the flexible hood in a compressed condition to prepare it for folding.
Figure 7:
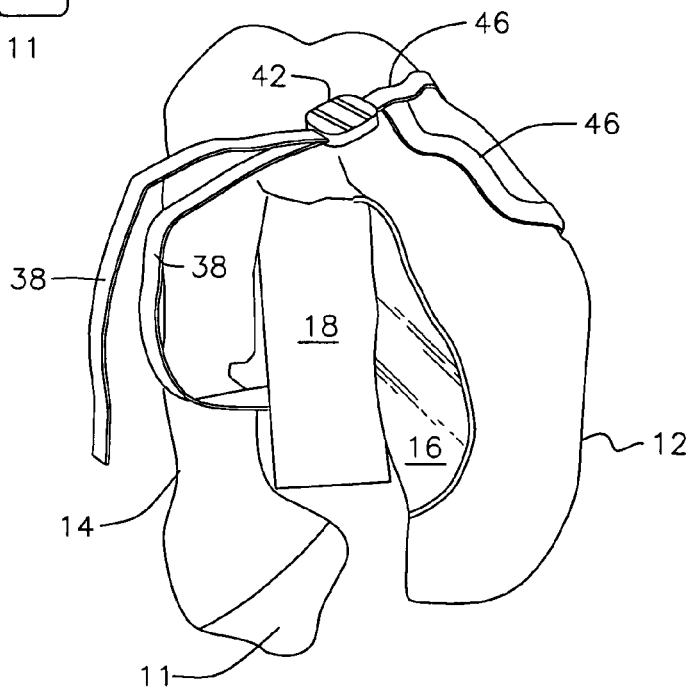
FIG. 7 is a side elevational view depicting the flexible hood of FIG. 6 in its folded configuration.

FIG. 6 depicts flexible hood 10 of either embodiment when in its compressed configuration. The compressed configuration is attained by positioning a back of the flexible hood in close proximity to a front of said flexible hood as indicated by directional arrow 50. Upper part 12 of flexible hood 12 is first placed into its retracted and compressed configuration preparatory to folding. Advantageously, as depicted in FIG. 7, visor 16 abuts filter housing 18 without being scratched, creased, or otherwise damaged by said housing when hood 10 is so stored.

Figure 8:
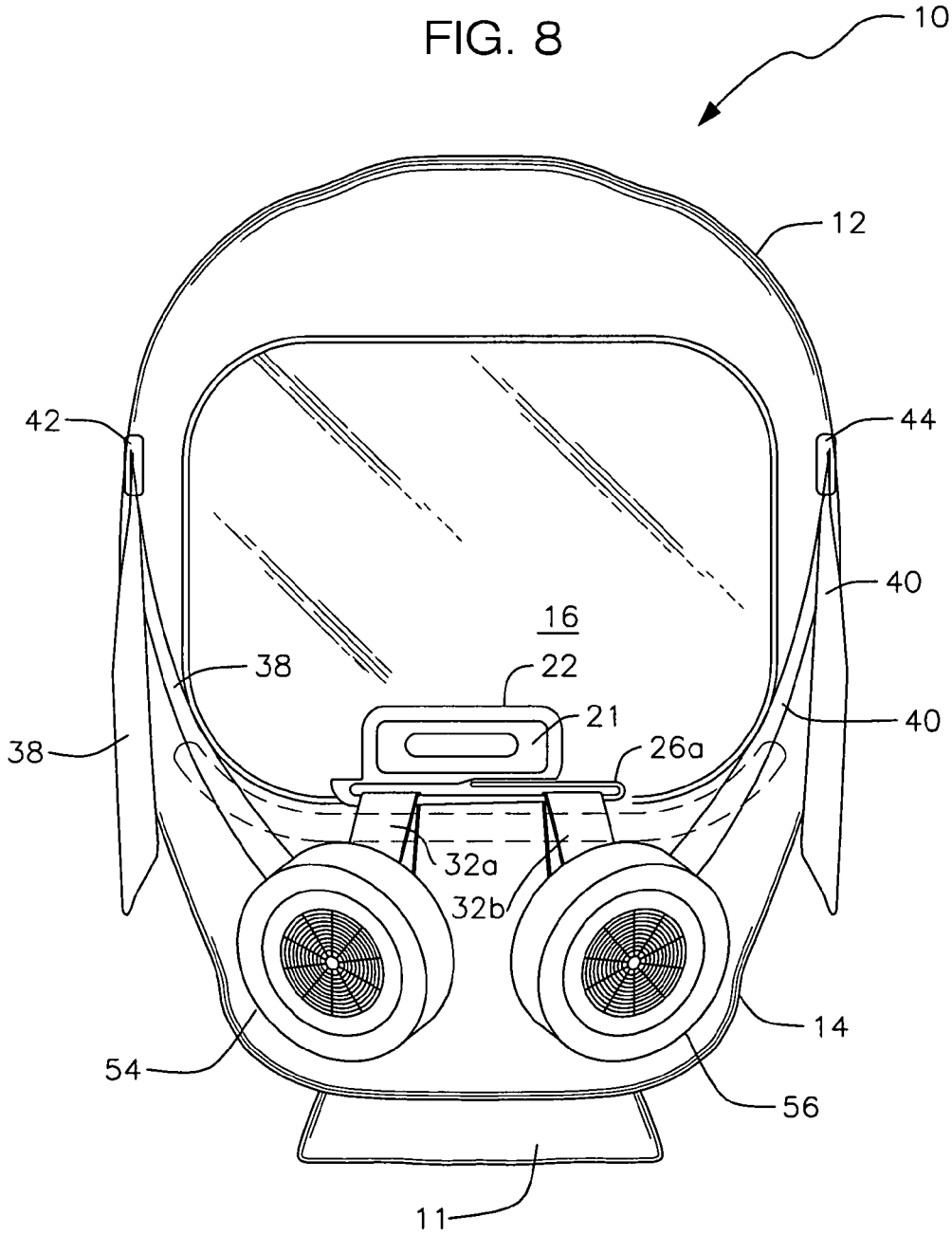
FIG. 8 is a front elevational view of an embodiment having two filters.

FIG. 8 depicts an embodiment where two filter housings 54, 56, each of which is adapted to house a filter, are mounted externally of flexible hood 10. First loop member 26*a* has a greater lateral extent than that of first loop member 26 and there are two continuous loop straps 32*a*, 32*b* that function in the same way as continuous loop strap 32 but in all other respects this embodiment works in the same way as the first two embodiments.

More particularly, the loop members formed in the rearward and forward ends of filter housing 54 are the second and third loop members of this second embodiment and the loop members formed in the rearward and forward ends of filter housing 56 are the fourth and fifth loop members of this second embodiment. Thus, when upper part 12 of flexible hood is in its extended configuration, first loop member 26*a* is in close proximity to the third and fifth loop members and when said upper part 12 is in its retracted configuration, first loop member 26*a* is in close proximity to the second and fourth loop members.

In all embodiments, it is easy for a user to extend or retract upper part 12 and hence visor 16 with respect to the viewer's eyes as needed by simply pushing or pulling nose clip 20 while holding filter housing 18 (or filters 54, 56) against movement. Pushing said nose clip (or half mask) towards a user's face positions visor 16 closer to the eyes of the user and pulling said nose clip away from the user's face positions visor 16 further from the eyes of the user. Since the positioning is infinitely adjustable between the two extremes, all users can position the visor to a comfortable position that accommodates spectacles, if any, and which optimizes the field of view.

Moreover, the hood is easily foldable when not in use to protect the visor from scratches, creases, and the like.

It will thus be seen that the advantages set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A protective apparatus, comprising: a flexible hood adapted to fully encapsulate a head of a user in a substantially airtight seal; said flexible hood having an upper part and a lower part; said upper part including a transparent visor adapted to enable a user to see therethrough when the flexible hood is worn; a lower part formed integrally with said upper part; said upper part having a first, extended position where said visor is adapted to be spaced a first predetermined distance from said user's eyes, said first, extended position being a position of repose of said upper part; said upper part having a second, retracted position where said visor is adapted to be spaced a second predetermined distance from said user's eyes, said second predetermined distance being less than said first predetermined distance; said upper part being adjustable between said extended position and said retracted position; said lower part having a fixed position; said protective apparatus adapted to protect said user when said upper part is in said extended position, when said upper part is in said retracted position, and when said upper part is in any preselected position between said extended and retracted positions; at least one filter housing secured to an external side of said lower part, said at least one filter housing adapted to house at least one filter; a breathing means positioned primarily in an interior of said flexible hood; said breathing means including a part thereof positioned externally to said flexible hood; a first loop member adapted to slidingly receive a strap therethrough; said first loop member being mounted to said part of said breathing means positioned externally to said flexible hood in depending relation thereto; a second loop member adapted to slidingly receive a strap therethrough being mounted to a top wall of said at least one filter housing at a rearward end thereof; a third loop member adapted to slidingly receive a strap therethrough being mounted to a top wall of said at least one filter housing at a forward end thereof; a strap in the form of a continuous loop being received within said first, second, and third loop members; said first and third loop members being in closely spaced relation to one another when said upper part of said flexible hood is in said first, extended position; said first and second loop members being in closely spaced relation to one another when said upper part of said flexible hood is in said second, retracted position; whereby said flexible hood is adapted to accommodate the head of a user having a large head and wearing spectacles when said upper part is in said first, extended position; whereby said flexible hood is adapted to accommodate the head of a user having a small head and not wearing spectacles when said upper part is in said second, retracted position; whereby there are an infinite number of positions of adjustment between said first, extended position and said second, retracted position so that said flexible hood is adapted to accommodate users having a wide variety of head sizes and users both wearing and not wearing spectacles; and whereby each user may adjust the position of said upper part of said flexible hood to optimize the field of vision by donning the flexible hood with the upper part in the first, extended position, and by retracting the upper part until further retraction is prevented by a user's head or spectacles.

2. The flexible hood of claim 1, further comprising: said breathing means including a mouthpiece positioned in an interior of said flexible hood, in said lower part, and in fluid communication with said at least one filter; said breathing means further including a nose clip positioned in an interior of said flexible hood, in said upper part; said breathing means further including an aperture formed in said visor; a nose clip base positioned in said aperture and having a perimeter that sealingly engages a periphery of said aperture, said nose clip base having a part thereof external to said flexible hood; said nose clip being formed integrally with said nose clip base; said first loop member depending from said part of said nose clip base that is external to said flexible hood; whereby said upper part of said flexible hood is expanded by holding said at least one filter housing against movement while pushing said nose clip away from a user's face; whereby said upper part of said flexible hood is retracted by holding said at least one filter housing against movement while pushing said nose clip towards a user's face.

3. The flexible hood of claim 2, further comprising: an imperforate, flexible membrane that interconnects said nose clip and said nose clip base so that said nose clip may be moved toward a user's face or away from a user's face to accommodate user's having heads of differing sizes.

4. The flexible hood of claim 1, further comprising: said flexible hood having a front and a back, said visor being mounted in said front of said flexible hood;

said flexible hood having a compressed configuration; said compressed configuration being attainable when said upper part of said flexible hood is in said second, retracted configuration; said compressed configuration being attainable when said flexible hood is not worn by a user; said compressed configuration being attained when said back of said flexible hood is displaced into close proximity to said front of said flexible hood.

5. The flexible hood of claim 4, further comprising: said flexible hood having a folded configuration where said upper part of said flexible hood is in said retracted and compressed configuration and is folded so that said visor overlies and abuts said at least one filter housing; whereby said at least one filter housing protects said visor from scratches and creases when said flexible hood is so folded.

6. The flexible hood of claim 1, further comprising: said breathing means including a half mask cup positioned primarily in an interior of said flexible hood, said half mask cup being adapted to cover the mouth and nose of a user; said half mask cup having a part thereof that is positioned external to said flexible hood; said first loop member depending from said part of said half mask cup that is external to said flexible hood; whereby said upper part of said flexible hood is expanded by holding said filter housing against movement while pushing said upper part of said flexible hood away from a user's face; whereby said upper part of said flexible hood is retracted by holding said filter housing against movement while pushing said upper part of said flexible hood towards a user's face.

7. The flexible hood of claim 1, further comprising: a fourth loop member secured to a first side of said at least one filter housing; a fifth loop member secured to a second side of said at least one filter housing; a first filter strap having a leading end secured to said fourth loop member; a second filter strap having a leading end secured to said fifth loop member; a first lock member secured to a first side of said upper part of said flexible hood; a second lock member secured to a second side of said upper part of said flexible hood; a continuous head loop strap that circumscribes said upper part of said flexible hood; said first lock member having a first strap-engaging part that adjustably engages a trailing end of said first filter strap; said first lock member having a second loop part through which extends said continuous loop head strap; said second lock member having a first strap-engaging part that adjustably engages a trailing end of said second filter strap; said second lock member having a second loop part through which extends said continuous loop head strap; whereby tightening said first and second filter straps tightens said continuous loop head strap.

8. A flexible hood, comprising: an upper part including a visor adapted to enable a user to see therethrough when the flexible hood is worn; a lower part formed integrally with said upper part; a pair of filter housings secured to an external side of said lower part in laterally spaced apart relation to one another, each of said filter housings adapted to house a filter; a breathing means positioned primarily in an interior of said flexible hood, said breathing means being in fluid communication with said filters; said breathing means including a part thereof positioned externally to said flexible hood; a first loop member adapted to slidingly receive a pair of straps therethrough; said first loop member being mounted to said part of said breathing means positioned externally to said flexible hood in depending relation thereto; a second loop member adapted to slidingly receive a strap therethrough being mounted to a top wall of a first filter housing at a rearward end thereof; a third loop member adapted to slidingly receive a strap therethrough being mounted to a top wall of said first filter housing at a forward end thereof; a fourth loop member adapted to slidingly receive a strap therethrough being mounted to a top wall of said second filter housing at a rearward end thereof; a fifth loop member adapted to slidingly receive a strap therethrough being mounted to a top wall of said second filter housing at a forward end thereof; a first continuous loop strap being received within said first, second, and third loop members; a second continuous loop strap being received within said first, fourth, and fifth loop members; said upper part of said flexible hood having a first, extended position where said first, third, and fifth loop members are in closely spaced relation to one another; said upper part of said flexible hood having a second, retracted position where said first, second, and fourth loop members are in closely spaced relation to one another; whereby said flexible hood is adapted to accommodate the head of a user having a large head and wearing spectacles when said upper part is in said first, extended position; whereby said flexible hood is adapted to accommodate the head of a user having a small head and not wearing spectacles when said upper part is in said second, retracted position; whereby there are an infinite number of positions of adjustment between said first, extended position and said second, retracted position so that said flexible hood is adapted to accommodate users having a wide variety of head sizes and users both wearing and not wearing spectacles; and whereby each user may adjust the position of said upper part of said flexible hood to optimize the field of vision by donning the flexible hood with the upper part in the first, extended position, and by retracting the upper part until further retraction is prevented by a user's head or spectacles.

9. The flexible hood of claim 8, further comprising: said breathing means including a nose clip positioned in an interior of said flexible hood, in said upper part; said breathing means further including an aperture formed in said visor; a nose clip base positioned in said aperture and having a perimeter that sealingly engages a periphery of said aperture, said nose clip base having a part thereof external to said flexible hood; said nose clip being formed integrally with said nose clip base; said first loop member depending from said part of said nose clip base that is external to said flexible hood; whereby said upper part of said flexible hood is expanded by holding said filter housings against movement while pushing said nose clip away from a user's face; whereby said upper part of said flexible hood is retracted by holding said filter housings against movement while pulling said nose clip towards a user's face.

10. The flexible hood of claim 9, further comprising: an imperforate, flexible membrane that interconnects said nose clip and said nose clip base so that said nose clip may be moved toward a user's face or away from a user's face to accommodate user's having heads of differing sizes.

11. The flexible hood of claim 8, further comprising: said flexible hood having a front and a back, said visor being mounted in said front of said flexible hood; said flexible hood having a compressed configuration; said compressed configuration being attainable when said upper part of said flexible hood is in its fully retracted configuration; said compressed configuration being attainable when said flexible hood is not worn by a user; said compressed configuration being attained when said back of said flexible hood is displaced into close proximity to said front of said flexible hood.

12. The flexible hood of claim 11, further comprising: said flexible hood having a folded configuration where said upper part of said flexible hood in said retracted and compressed configuration is folded so that said visor overlies and abuts said pair of filter housings; whereby said pair of filter housings protect said visor from scratches and creases when said flexible hood is so folded.

13. The flexible hood of claim 8, further comprising: said breathing means including a half mask cup positioned primarily in an interior of said flexible hood, said half mask cup being adapted to cover the mouth and nose of a user; said half mask cup having a part thereof that is positioned external to said flexible hood; said first loop member depending from said part of said half mask cup that is external to said flexible hood; whereby said upper part of said flexible hood is expanded by holding said pair of filter housings against movement while pushing said upper part of said flexible hood away from a user's face; whereby said upper part of said flexible hood is retracted by holding said pair of filter housings against movement while pushing said upper half of said flexible hood towards a user's face.

14. The flexible hood of claim 8, further comprising: a first filter loop member secured to a first side of said filter housing; a second filter loop member secured to a second side of said filter housing; a first filter strap having a leading end secured to said first filter loop member; a second filter strap having a leading end secured to said second filter loop member; a first lock member secured to a first side of said upper part of said flexible hood; a second lock member secured to a second side of said upper part of said flexible hood; a continuous head loop strap that circumscribes said upper part of said flexible hood; said first lock member having a first strap-engaging part that adjustably engages a trailing end of said first filter strap; said first lock member having a second loop part through which extends said continuous loop head strap; said second lock member having a first strap-engaging part that adjustably engages a trailing end of said second filter strap; said second lock member having a second loop part through which extends said continuous loop head strap; whereby tightening of said first and second filter straps tightens said continuous loop head strap.

* * * * *